US006749464B2

(12) United States Patent
Obata

(10) Patent No.: US 6,749,464 B2
(45) Date of Patent: Jun. 15, 2004

(54) SHIELD CONNECTOR INCLUDING MALE CONNECTOR AND FEMALE CONNECTOR

(75) Inventor: Ken Obata, Tokyo (JP)

(73) Assignee: The Furukawa Electric, Co., Ltd., Tokyo (JP)

( * ) Notice: Subject to any disclaimer, the term of this patent is extended or adjusted under 35 U.S.C. 154(b) by 0 days.

(21) Appl. No.: 10/187,085

(22) Filed: Jun. 28, 2002

(65) Prior Publication Data

US 2003/0008555 A1 Jan. 9, 2003

(30) Foreign Application Priority Data

Jul. 4, 2001 (JP) ..... 2001-203354

(51) Int. Cl.[7] ..... H01R 9/03
(52) U.S. Cl. ..... 439/610; 439/578
(58) Field of Search ..... 439/607, 608, 439/609, 610, 901, 578, 585, 86, 98, 88, 675, 620, 284, 290, 291

(56) References Cited

U.S. PATENT DOCUMENTS 4,192,566 A * 3/1980 Laudig et al. ..... 439/610
5,911,599 A * 6/1999 Masuda ..... 439/610

* cited by examiner

*Primary Examiner*—Son V. Nguyen
(74) *Attorney, Agent, or Firm*—Knobbe, Martens, Olson & Bear, LLP

(57) ABSTRACT

A shield connector includes a male connector having a first housing accommodating therein a male terminal and a first shield pipe, and a female connector having a second housing accommodating therein a female terminal and a second shield pipe. When the male and female connectors are fitted to each other, the male terminal is fitted to the female connector and distal end portions of the first and second shield pipes are fitted to each other. At this time, upper and lower halves of the distal end portion of the first shield pipe are disposed outside an upper half of and inside a lower half of the distal end portion of the second shield pipe, respectively.

8 Claims, 8 Drawing Sheets

10B
10s
10r
10q
24
22
Y
34
40
34a
34b
IIB
20a
20b
IIC
38
V
20
X
10A

PRIOR ART

SHIELD CONNECTOR INCLUDING MALE CONNECTOR AND FEMALE CONNECTOR

BACKGROUND OF THE INVENTION

1. Technical Field

The present invention relates to a shield connector used to connect shield wires.

2. Related Art

A shield wire is comprised of a covered conductor and a shield layer, constituted by a shield brading or the like, that are covered with an insulation sheath. In order to connect such shield wires, a shield connector is employed. A shield connector is comprised of male and female connectors adapted to be fitted to each other. Each connector has a housing that accommodates therein a connector terminal and a shield pipe to which a covered conductor and a shield layer of a shield wire are connected, respectively. The conductor extending through the connector is shielded from external electric field by the shield pipes.

FIGS. 6A, 6B, 7, 8A and 8B show by way of example a conventional shield connector comprised of male and female connectors 12 and 14 to which shield wires 10A and 10B are connected, respectively.

The male connector 12 includes a first housing 16 for receiving a male terminal 18 and a first shield pipe 20. The housing 16 is constituted by inner and outer housings 16*a*, 16*b* between which the shield pipe 20 is disposed. The shield pipe 20 may be inserted between the inner and outer housings 16*a*, 16*b* fabricated beforehand or may be formed integrally with the housings 16*a*, 16*b* by means of insert forming. A first shield wire 10A has its distal end portion whose insulation sheath 10*s* and insulating coating 10*q* are peeled off, so that a shield layer 10*r* and a covered conductor are exposed from the insulation sheath 10*s* and further a central conductor 10*p* is exposed from the insulating sheath 10*q*. The male terminal 18 is inserted into the inner housing 16*a* of the male connector 12 and retains a distal end of the covered conductor of the shield wire 10A, with the exposed central conductor 10*p* of the covered conductor crimped and connected to the male terminal 18.

Further, the male connector 12 has an elastic ring 22 made of silicon rubber or the like and press-fitted to the shield pipe 20. The elastic ring 22 has resiliency to electrically connect the shield layer 10*r* to the shield pipe 20, which layer extends from between the elastic ring 22 and the insulating coating 10*q* to a distal end face of the elastic ring 22 and which is folded back to the insulation sheath 10*s*. The folded-back end of the shield layer 10*r* is fixed to the insulation sheath 10*s* by means of a fastening ring 24 of the male connector 12. The male connector 12 further includes a wire seal ring 26 of silicon rubber or the like which is press-fitted to the outer housing 16*b* for water-tightly sealing between the shield wire 10A and the outer housing 16*b*, and a backup ring 28 of engineering plastic or the like which is fitted to an end of the outer housing 16*b* for preventing the wire seal ring 26 from being detached from the outer housing 16*b*.

The female connector 14 is fabricated basically in the same manner as the male connector 12. In FIGS. 6A and 6B, reference numeral 30 denotes a second housing comprised of inner and outer housings 30*a*, 30*b* between which a second shield pipe 34 is disposed. Accommodated in the inner housing 30*a* is a female terminal 32 to which a central conductor 10*p* of a second shield wire 10B is crimped and connected. The outer housing 30*b* is formed at its intermediate portion with an inner tube 30*c*. A housing seal ring 36 is disposed on an outer periphery of the inner tube 30*c*.

In the shield connector configured as mentioned above, the male and female connectors 12, 14 are fitted to each other as shown in FIGS. 6A and 6B, whereby the male terminal 18 is fitted to the female terminal 32 to establish electrical connection between central conductors 10*p* of the shield wires 10A, 10B that are individually connected to the terminals 18, 32. Furthermore, respective distal end portions of the shield pipes 20, 34 of the connectors 12, 14 are fitted to each other, whereby electrical connection is established between the shield layers 10*r* of the shield wires 10A, 10B individually connected to the shield pipes 20, 34. In addition, the outer housing 16*b* of the male connector 12 is fitted between the outer housing 30*b* of the female connector 14 and the housing seal ring 36, which water-tightly seals between the outer housings 16*b* and 30*b*.

The conventional shield connector has a drawback that the covered conductor comprised of the central conductor 10*p* and the insulating coating 10*q* of the shield wire 10A is bent obliquely upward between the elastic ring 22 and a proximal end of the male terminal 18, whereas the covered conductor of the shield wire 10B is bent obliquely downward between the elastic ring 22 and a proximal end of the female terminal 32, as shown in FIGS. 6A and 7.

The reason why the covered conductors are bent will be explained. Both the male and female terminals 18 and 32 are generally fabricated by press-forming a thin metal plate. In the fabrication, a bottom face of each terminal serves as a reference face to provide the terminal with a proximal-end crimp portion and a distal-end fitting portion. The male and female terminals 18, 32 are substantially the same in the construction of their crimp portions, but differ from each other in the construction of their distal-end fitting portions. That is, the distal-end fitting portion of the male terminal 18 is formed into a plate shape, whereas the distal-end fitting portion of the female terminal 32 is configured to have elastic tongues to which the plate like distal-end fitting portion of the male terminal 18 is fitted. Thus, the female terminal 32 is larger than the male terminal 18 in a height measured from the bottom face to the top face of the distal-end fitting portion. For this reason, when the male terminal 18 is fitted to the female terminal 32, the bottom face of the female terminal 32 is located below that of the male terminal 18. Since, a vertical distance between the central axis at the proximal-end crimp portion and the bottom face of the terminal is substantially the same between the male and female terminals 18, 32, the proximal-end crimp portion of the female terminal 32 is located below that of the male terminal 18. Accordingly, the central axis U1 at the proximal-end crimp portion of the male terminal 18 (i.e., the distal end of the covered conductor of the first shield wire 10A) is positioned above the central axis V at the distal-end fitting portion of the male terminal 18, and the central axis U2 at the proximal-end fitting portion of the female terminal 32 (i.e., the distal end of the covered conductor of the second shield wire 10B ) is positioned below the central axis V. On the other hand, each of the first and second shield wires 10A, 10B is supported by the ring 22, etc. disposed in the shield pipe, so as to be aligned with the central axis V at the connector end.

As explained above, according to the conventional shield connector having the first and second shield pipes 20, 34 disposed coaxially with each other, the covered conductor of the first shield wire 10A at one end of the connector is positioned at the same height as the central axis V, with a distal end thereof positioned above the central axis V, so that the covered conductor is bent obliquely upward. On the other hand, the covered conductor of the second shield wire 10B at the other end of the connector is positioned at the same height as the central axis V, with a distal end thereof positioned above the central axis V, so that the covered conductor is bent obliquely downward. Resilient forces produced by the covered conductors that are bent in the above manner act to incline the distal ends of the male and female terminals 18, 32 obliquely upward and downward, and thus the distal-end fitting portions of the terminals 18, 32 may be deformed, causing inconveniences in electrically connecting shield wires through the terminals 18, 32.

SUMMARY OF THE INVENTION

An object of the present invention is to provide a shield connector which prevents or suppresses covered conductors of shield wires from being bent in the shield connector, thereby achieving reliable connection of the shield wires.

According to the present invention, there is provided a shield connector which includes a male connector having a male terminal to which a covered conductor of a first shield wire is connected, a first shield pipe to which a shield layer of the first shield wire is connected, and a first housing for accommodating therein the male terminal and the first shield pipe; and a female connector having a female terminal to which a covered conductor of a second shield wire is connected, a second shield pipe to which a shield layer of the second shield wire is connected, and a second housing for accommodating therein the female terminal and the second shield pipe, wherein, when the male and female connectors are fitted to each other, the male terminal is fitted to the female terminal and distal end portions of the first and second shield pipes are fitted to each other. In the shield connector, the improvement comprises that the first and second shield pipes are arranged such that an axis of the first shield pipe is positioned away from reference faces of the male and female terminals with respect to a central axis passing through distal-end fitting portions of the male and female terminals and an axis of the second shield pipe is positioned close to the reference faces with respect to the central axis, as viewed in a direction perpendicular to the axes of the first and second shield pipes.

As mentioned above, according to the conventional arrangement where the first and second shield pipes are arranged in alignment with the central axis passing through distal-end fitting portions of the male and female terminals, the first and second shield wires supported coaxially with the first and second shield pipes are aligned with the central axis, whereas distal ends of covered conductors of the first and second shield wires connected to proximal ends of the male and female terminals are positioned out of alignment with the central axis, and accordingly the covered conductors of the shield wires are bent.

On the contrary, according to the present invention, the axis of the first shield pipe is positioned away from the reference faces of the male and female terminals with respect to the central axis, and accordingly both the first shield wire and the distal end of the covered conductor thereof are positioned at substantially the same height on the axis of the first shield pipe, whereby the covered conductor of the first shield wire is prevented or suppressed from being bent. Furthermore, since the axis of the second shield pipe is positioned close to the reference faces of the male and female terminals with respect to the central axis, both the second shield wire and the distal end of the covered conductor thereof are positioned at substantially the same height on the axis of the second shield pipe, thereby preventing or suppressing the covered conductor of the second shield wire from being bent. As a result, the shield connector of the present invention can prevent or suppress deformation of the male and female terminals which would otherwise be caused by resilient forces produced by covered conductor subject to bending, establishing a satisfactory connection between the first and second shield wires through the shield connector.

DETAILED DESCRIPTION

Figure 1:
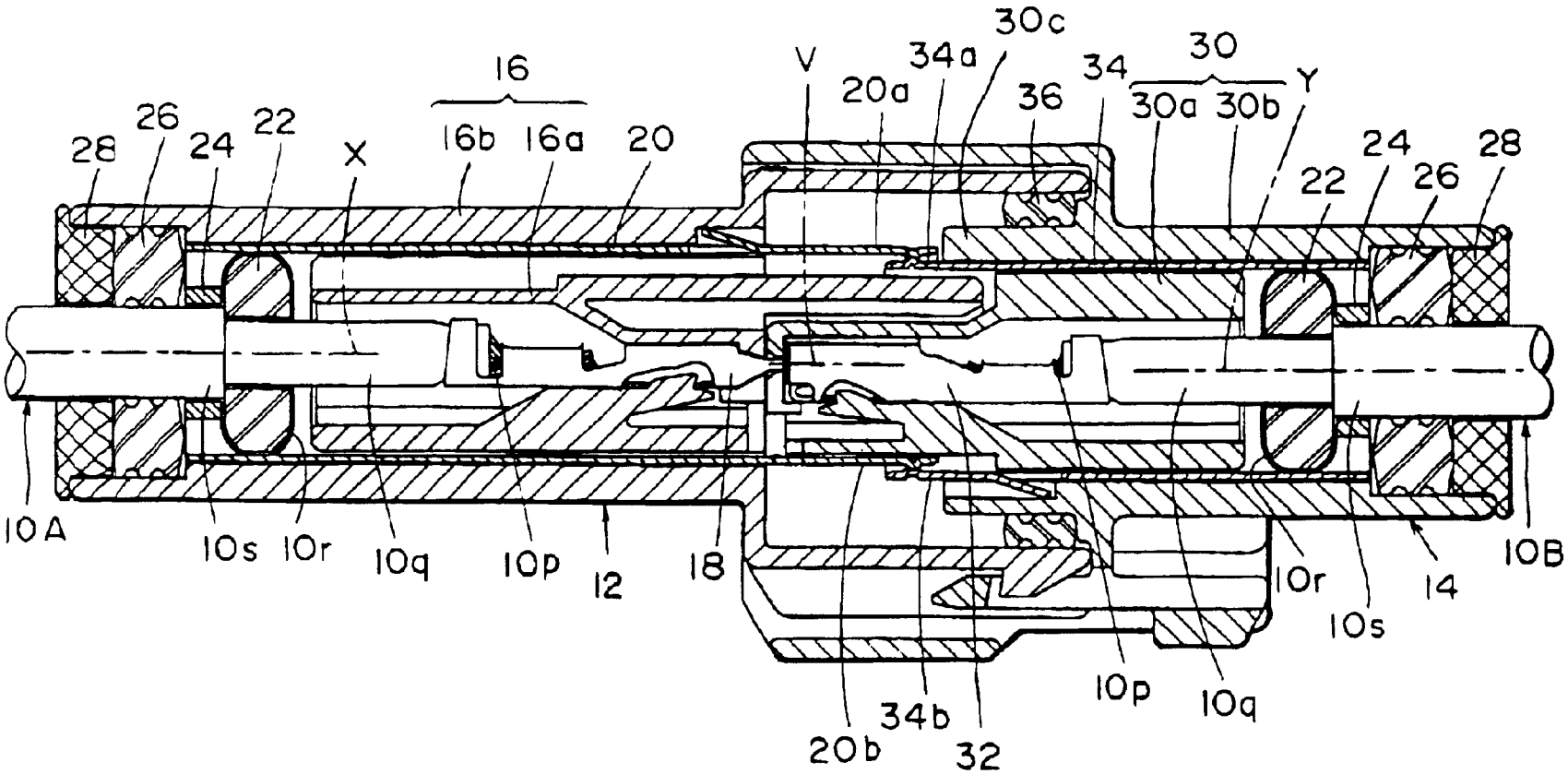
FIG. 1 is a vertical section view of a shield connector according to a first embodiment of the present invention.

With reference to FIG. 1 through FIG. 3B, a shield connector according to a first embodiment of this invention will be described.

The shield connector of this embodiment is fabricated basically in the same manner as the conventional shield connector shown in FIG. 6A through FIG. 9, except that housings 16,30, shield pipes 20, 34 and rings 22, 24, 28, 36 are slightly larger in diameter than conventional ones, and is adapted to connect first and second shield wires 10A, 10B through male and female connectors 12, 14 that are fitted to each other. Male and female terminals 18, 32 are fabricated by press-forming a thin metal plate, for instance, and have their flat bottom faces serving as reference faces. Further explanations as to elements of the shield connector similar to conventional ones are omitted herein.

As compared to the conventional shield connector, the shield connector of this embodiment is mainly different therefrom in construction of distal end portions of the shield pipes 20, 30 of the male and female connectors 12, 14, i.e., the first and second shield pipes.

Figures 2A, 2B, 2C:
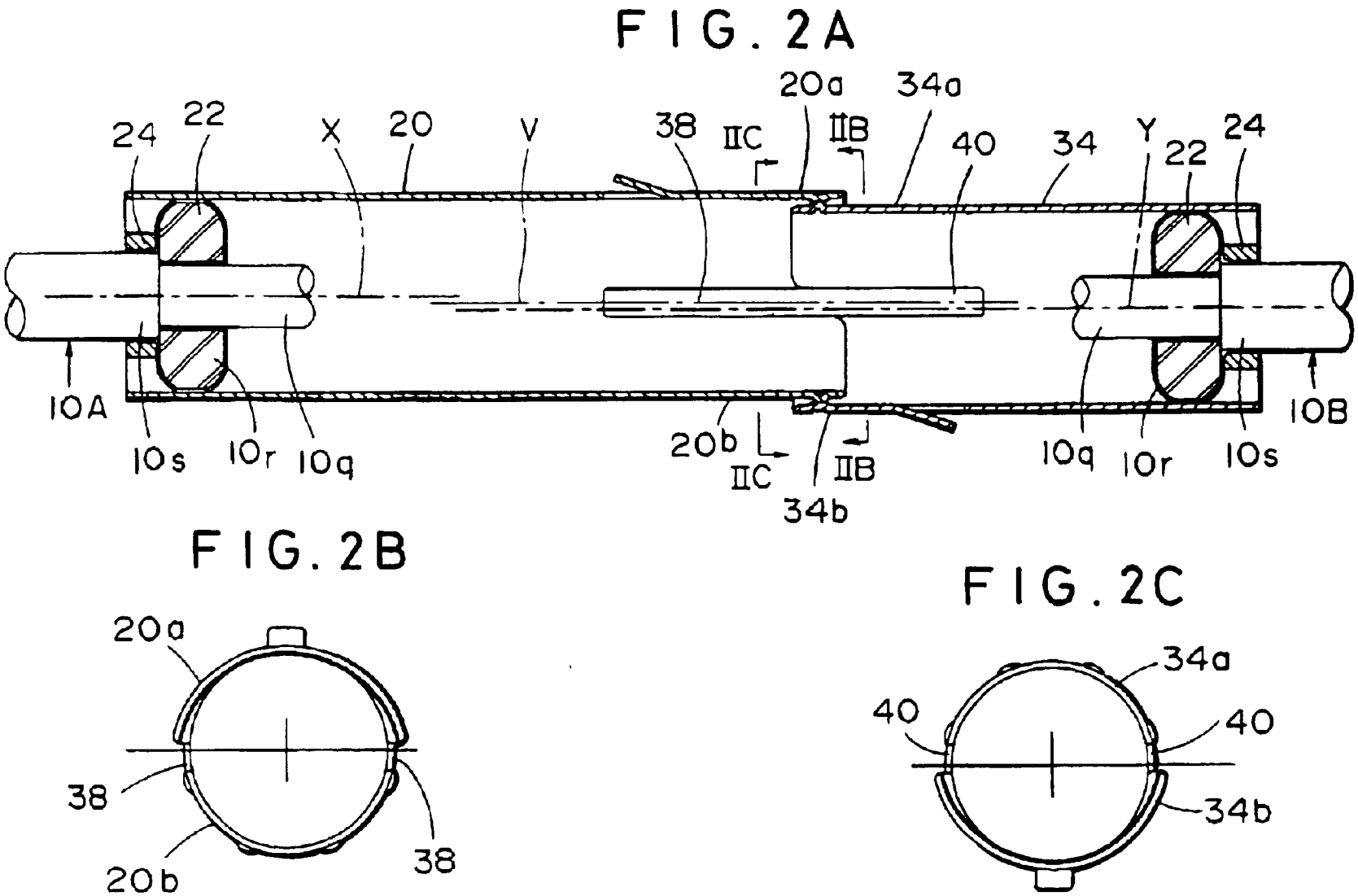
FIG. 2A is a vertical section view showing structural elements that are mainly associated with establishing a connection between shield wires among the elements of the shield connector shown in FIG. 1.
FIG. 2B is a sectional view taken along line IIB—IIB in FIG. 2A.
FIG. 2C is a sectional view taken along line IIC—IIC in FIG. 2A.
Figure 3B:
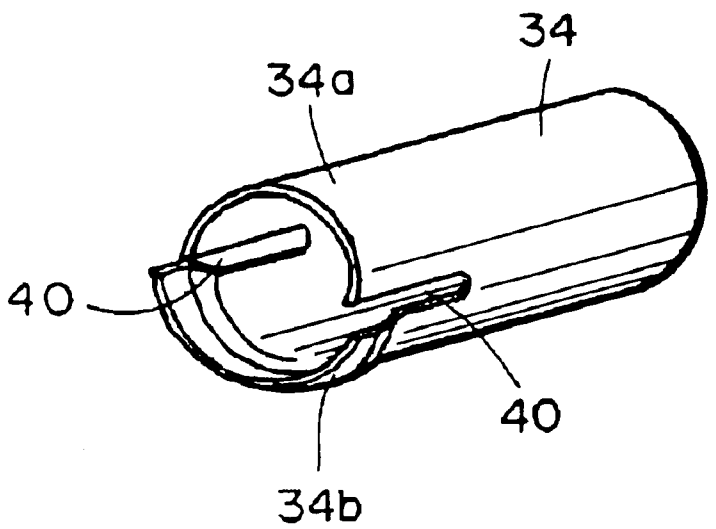
FIG. 3B is a perspective view of a shield pipe of a female connector shown in FIG. 1.
Figure 3A:
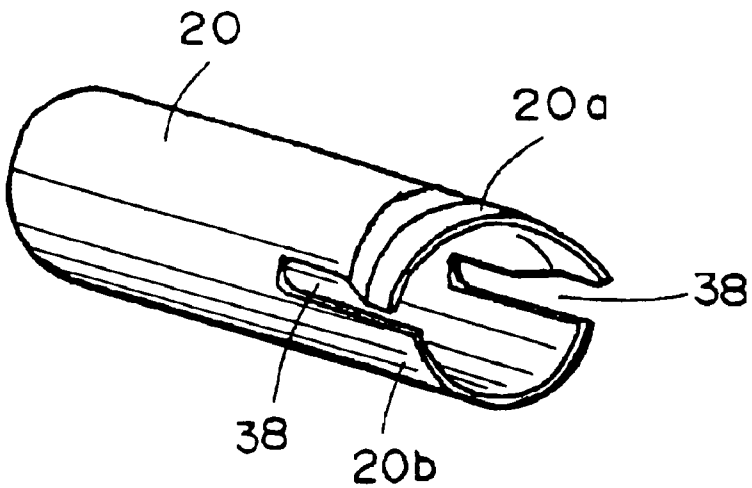
FIG. 3A is a perspective view of a shield pipe of a male connector shown in FIG. 1.

More specifically, as shown in FIGS. 2A, 2B and 3A, the shield pipe 20 of the male connector 12 is constituted by a cylindrical pipe and has a distal end portion thereof formed with two slots 38 that axially extend and are located diametrically opposite to each other. By means of the slots 38, the distal end portion of the shield pipe 20 is separated into an upper half (first half) located on the side remote from the bottom faces of the male and female terminals 18, 32 with respect to the axis of the shield pipe 20 and a lower half (second half) located on the side close to the bottom faces of the terminals. Each half 20*a* or 20*b* is semi-circular in cross section. As shown in FIG. 2B, the lower half 20*b* of the distal end portion of the shield pipe 20 is formed to have the same diameter as that of a proximal end portion of the shield pipe 20. On the other hand, the upper half 20*a* of the distal end portion is formed to have a radius of curvature which is larger than the radius of the lower half 20*b*.

As shown in FIGS. 2A, 2C and 3B, the shield pipe 34 of the female connector 14 is constituted by a cylindrical pipe, and is formed at its distal end portion with two slots 40 that axially extend and are located diametrically opposite to each other. By means of the slots 40, the distal end portion of the shield pipe 34 is separated into an upper half 34*a* and a lower half 34*b*. The upper half 34*a* of the distal end portion of the shield pipe 34 is formed to have the same diameter as that of a proximal end portion of the pipe 34, whereas the lower half 34*b* thereof is formed to have a radius of curvature which is larger than that of the upper half 34*a*, as shown in FIG. 2C. The shield pipes 20 and 34 are the same in diameter except for their distal end portions.

The shield pipes 20 and 34 constructed as mentioned above are individually accommodated in the housings 16, 30 of the male and female connectors 12, 14 and are fitted to each other as shown in FIG. 1. At this time, as shown in FIG. 2A, the upper half 20*a* of the distal end portion of the shield pipe 20 of the male connector 12 is located outside the upper half 34*a* of the distal end portion of the female connector 14 and the lower half 20*b* of the distal end portion of the shield pipe 20 is located inside the lower half 34*b* of the distal end portion of the shield pipe 34 of the female connector 14, with the male and female terminals 18 and 32 fitted to each other. More specifically, as shown in FIG. 2A, the shield pipes 20 and 34 are fitted to each other, with their central axes X and Y out of alignment with each other as viewed in the vertical direction. In FIG. 2A, symbol V denotes a central axis, passing through distal-end fitting portions of the male and female terminals 18, 32, that is located between the central axes X, Y of the shield pipes 20, 34. The central axis X of the shield pipe 20 is located above the central axis V, whereas the central axis Y of the shield pipe 34 is located below the central axis V.

As explained above, the shield connector of this embodiment is configured that the male and female terminals 18, 32 and the shield pipes 20, 34 are disposed to satisfy the aforesaid positional relationship between the central axes X, Y and V when the male and female connectors 12, 14 are fitted to each other. As a result, the covered conductors of the first and second shield wires 10A , 10B are prevented or suppressed from being bent in the male and female connectors 12 and 14, whereby the male and female connectors 12, 14 are prevented from being inclined and the male and female terminals 18, 32 are prevented from being deformed, which would be otherwise caused by resilient forces produced by the covered conductors subject to bending. Accordingly, the first and second shield wires 10A, 10B are electrically connected through the shield connector with reliability.

In the following, a shield connector according to a second embodiment of this invention will be explained with reference to FIG. 4.

The shield connector of this embodiment is basically the same in construction as the first embodiment, but differs therefrom in that only the shield pipe 20 of the male connector 12 is formed with two slots 38. The shield pipe 34 of the female connector 14 is constituted by a right cylindrical pipe having no slots formed therein.

More specifically, an upper half 20*a* of the distal end portion of the shield pipe 20 is formed to have a radius of curvature which is larger than the radius of the shield pipe 34, so that the upper half 20*a* is in contact with an outer peripheral face of the shield pipe 34. On the other hand, a lower half 20*b* of the distal end portion of the shield pipe 20 is formed to have a radius of curvature smaller than the radius of the shield pipe 34, so that the lower half 20*b* is inserted into the shield pipe 34. The shield pipe 20 is the same in diameter as the shield pipe 34 except for the distal end portion. In other respects, the shield connector of this embodiment is the same as the first embodiment, and hence explanations thereof are omitted.

Figure 4:
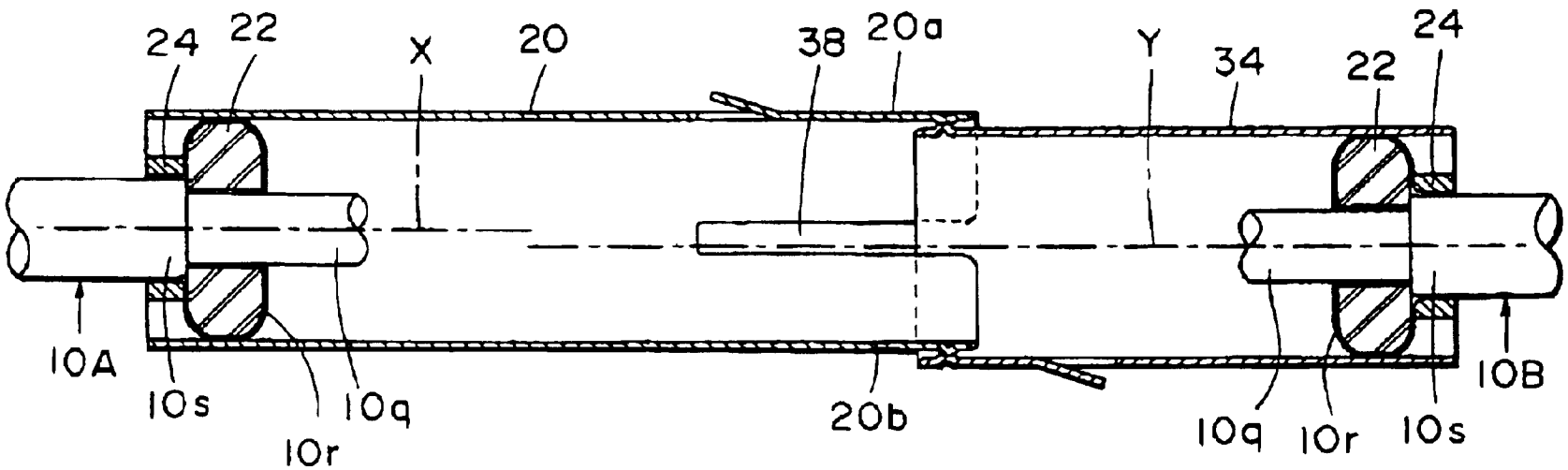
FIG. 4 is a vertical section view of a shield connector according to a second embodiment of the present invention.

In the shield connector having the above construction, the shield pipes 20, 34 of the male and female connectors 12 and 14 are fitted to each other, with their central axes X and Y being out of alignment as shown in FIG. 4 when the connectors 12, 14 are fitted to each other. Specifically, the axes X and Y of the shield pipes 20, 34 are individually positioned above and below the central axis (not shown) that passes through the distal-end fitting portions of the male and female terminals, whereby the covered conductors of the first and second shield wires in the shield connector are prevented or suppressed from being bent, as in the case of the first embodiment.

In the following, a shield connector according to a third embodiment of this invention will be explained with reference to FIG. 5.

The shield connector of this embodiment is basically the same as the first embodiment, but differs therefrom in that only the shield pipe 34 of the female connector 14 is formed with two slots 40. The shield pipe 20 of the male connector 12 is constituted by a right cylindrical pipe having no slots formed therein. More specifically, an upper half 34a of the distal end portion of the shield pipe 34 is formed to have a radius of curvature smaller than the radius of the shield pipe 20 so as to be inserted to the shield pipe 20, whereas a lower half 34*b* thereof is formed to have a radius of curvature larger than the radius of the shield pipe 20 so as to be in contact with the outer peripheral face of the shield pipe 20. The shield pipe 34 is the same in diameter as the shield pipe 20 except for the distal end portion. In other respects, the shield connector of this embodiment is the same as the first embodiment, and hence explanations thereof are omitted.

Figure 5:
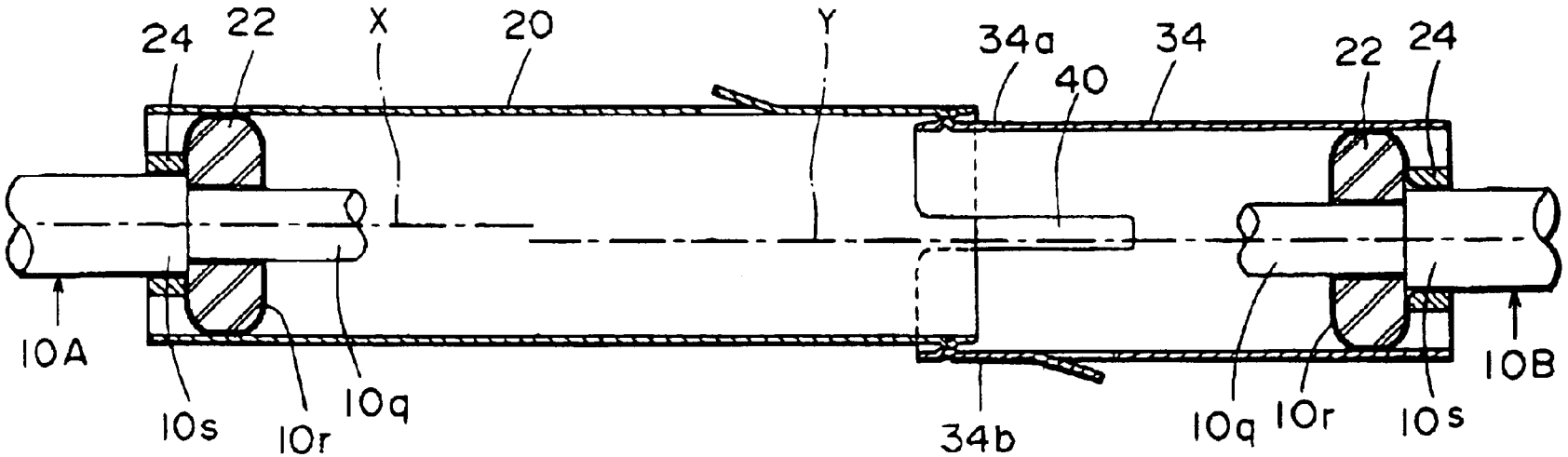
FIG. 5 is a vertical section view of a shield connector according to a third embodiment of the present invention.
Figure 6A:
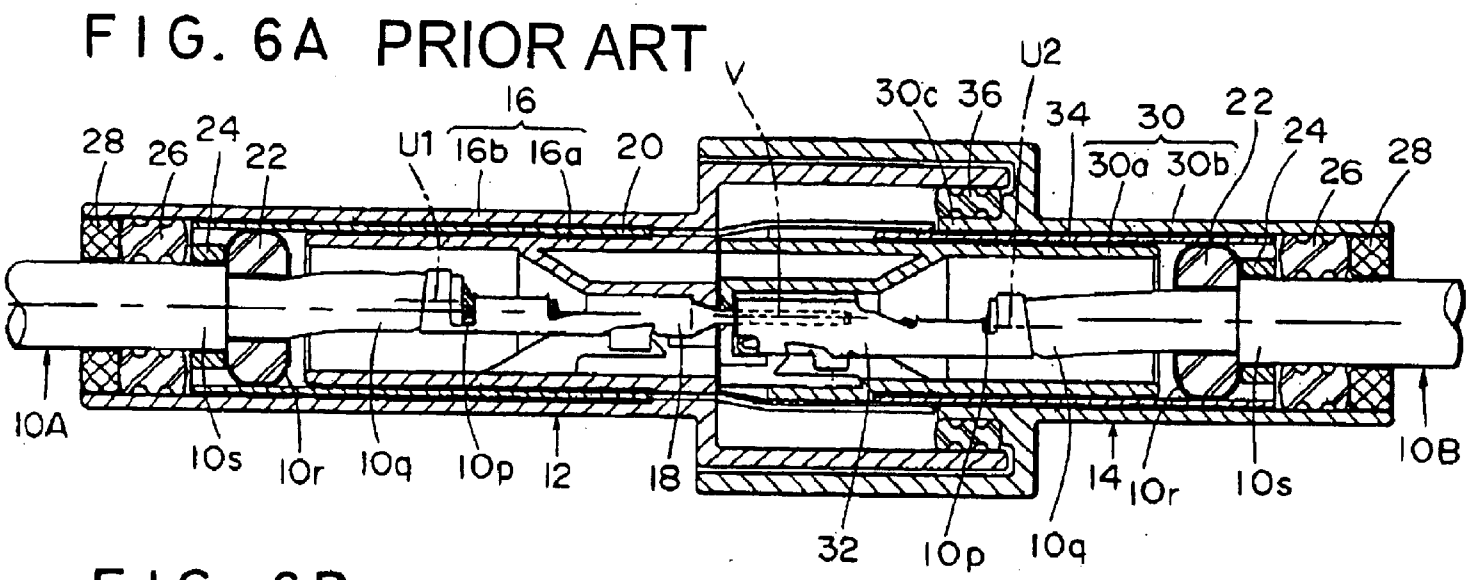
FIG. 6A PRIOR ART
FIG. 6A is a vertical section view of a conventional shield connector.
Figure 6B:
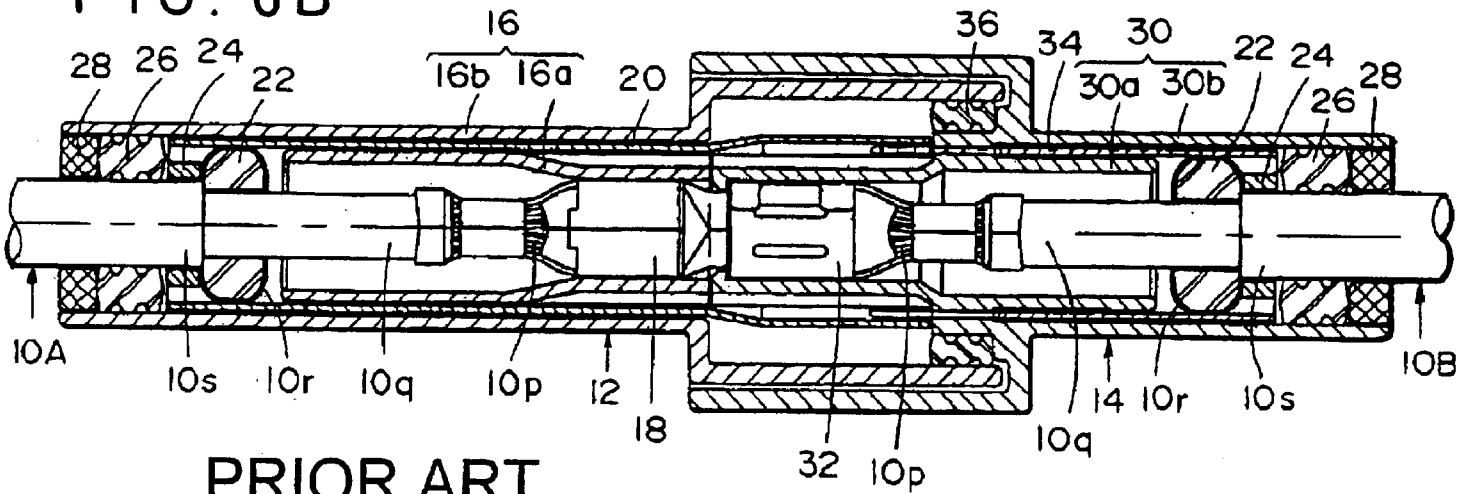
FIG. 6B PRIOR ART
FIG. 6B is a horizontal section view of the shield connector shown in FIG. 6A.
Figure 7:
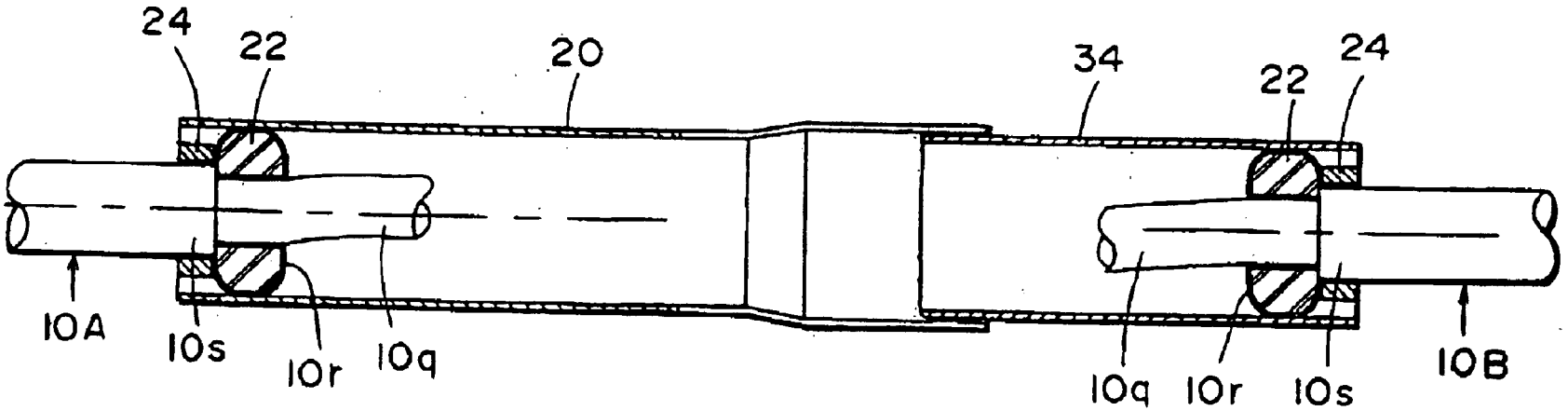
FIG. 7 PRIOR ART
FIG. 7 is a vertical section view showing structural elements that are mainly associated with establishing a connection between shield wires among the elements of the shield connector shown in FIGS. 6A and 6B.
Figure 8B:
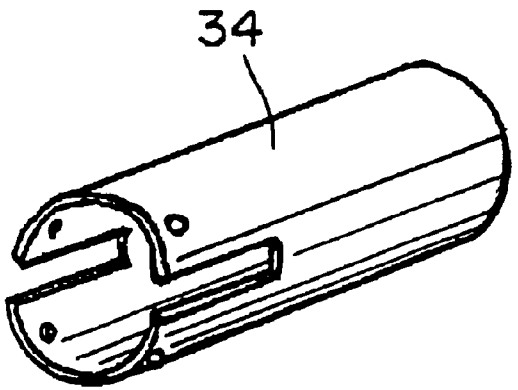
FIG. 8B is a perspective view of a shield pipe of a female connector.
Figure 8A:
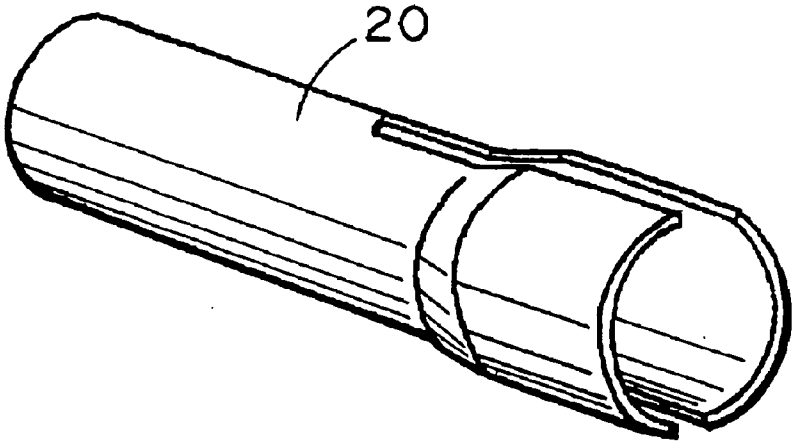
PRIOR ART FIG. 8A
FIG. 8A is a perspective view of a shield pipe of a male connector shown in FIGS. 6A, 6B and 7.

In the shield connector having the above construction, the shield pipes 20, 34 of the male and female connectors 12 and 14 are fitted to each other, with their central axes X and Y being out of alignment as shown in FIG. 5 and being individually positioned above and below the axis (not shown) passing through the distal-end fitting portions of the terminals, when the connectors 12 and 14 are fitted to each other, whereby the covered conductors of the first and second shield wires in the shield connector are prevented or suppressed from being bent, as in the case of the first embodiment.

What is claimed is:

1. A shield connector including a male connector having a male terminal to which a covered conductor of a first shield wire is connected, a first shield pipe to which a shield layer of the first shield wire is connected, and a first housing for accommodating therein the male terminal and the first shield pipe; and a female connector having a female terminal to which a covered conductor of a second shield wire is connected, a second shield pipe to which a shield layer of the second shield wire is connected, and a second housing for accommodating therein the female terminal and the second shield pipe, wherein when the male and female connectors are fitted to each other, the male terminal is fitted to the female terminal and distal end portions of the first and second shield pipes are fitted to each other, the improvement comprising:

the first and second shield pipes being arranged such that an axis of the first shield pipe is positioned away from reference faces of the male and female terminals with respect to a central axis passing through distal-end fitting portions of the male and female terminals and an axis of the second shield pipe is positioned close to the reference faces with respect to the central axis, as viewed in a direction perpendicular to the axes of the first and second shield pipes, wherein the distal end portion of each of the first and second shield pipes includes first and second halves that are individually located remote from and close to the reference faces of the male and female terminals with respect to the axes of the first and second shield pipes, wherein the first and second halves of the distal end portion of the first shield pipe are arranged outside the first half and inside the second half of the distal end portion of the second shield pipe, respectively, when the male and female terminals are fitted to each other, wherein the first and second shield pipes are each comprised of a cylindrical pipe, wherein each of the first and second shield pipes is formed at the distal end portion with two slots that axially extend and disposed diametrically opposite to each other, the two slots dividing the distal end portion into the first and second halves, wherein the first half of the distal end portion of the first shield pipe is larger in radius of curvature than the first half of the distal end portion of the second shield pipe, and wherein the second half of the distal end portion of the first shield pipe is smaller in radius of curvature than the second half of the distal end portion of the second shield pipe.

2. The shield connector according the claim 1, wherein each of the first and second housings has outer and inner housings between which a corresponding one of the first and second shield pipes is mounted, and the male and female terminals are disposed in the inner housings of the first and second housings, respectively.

3. The shield connector according the claim 2, further including:

a first ring disposed in the first shield pipe coaxially therewith for coaxially holding the first shield wire, and a second ring disposed in the second shield pipe coaxially therewith for coaxially holding the second shield wire.

4. The shield connector according to claim 3, wherein the male and female terminals are each fabricated by press-forming a thin metal plate, with their bottom faces that constitute the reference faces being used as a reference for fabrications, and a vertical distance between a bottom face and a top face of the male terminal at its distal end portion is smaller than a vertical distance between a bottom face and a top face of the female terminal.

5. A shield connector including a male connector having a male terminal to which a covered conductor of a first shield wire is connected, a first shield pipe to which a shield layer of the first shield wire is connected, and a first housing for accommodating therein the male terminal and the first shield pipe; and a female connector having a female terminal to which a covered conductor of a second shield wire is connected, a second shield pipe to which a shield layer of the second shield wire is connected, and a second housing for accommodating therein the female terminal and the second shield pipe, wherein when the male and female connectors are fitted to each other, the male terminal is fitted to the female terminal and distal end portions of the first and second shield pipes are fitted to each other, the improvement comprising:

the first and second shield pipes being arranged such that an axis of the first shield pipe is positioned away from reference faces of the male and female terminals with respect to a central axis passing through distal-end fitting portions of the male and female terminals and an axis of the second shield pipe is positioned close to the reference faces with respect to the central axis, as viewed in a direction perpendicular to the axes of the first and second shield pipes, wherein the distal end portion of each of the first and second shield pipes includes first and second halves that are individually located remote from and close to the reference faces of the male and female terminals with respect to the axes of the first and second shield pipes, and wherein the first and second halves of the distal end portion of the first shield pipe are arranged outside the first half and inside the second half of the distal end portion of the second shield pipe, respectively, when the male and female terminals are fitted to each other, wherein the first and second shield pipes are each comprised of a cylindrical pipe, wherein the distal end portion of only one of the first and second shield pipes is formed with two slots axially extending and located diametrically opposite to each other, the two slots dividing the distal end portion of the only one of the first and second shield pipes into the first and second halves, wherein the first half of the distal end portion of the first shield pipe is larger in radius of curvature than the first half of the distal end portion of the second shield pipe, and wherein the second half of the distal end portion of the first shield pipe is smaller in radius of curvature than the second half of the distal end portion of the second shield pipe.

6. The shield connector according the claim 5, wherein each of the first and second housings has outer and inner housings between which a corresponding one of the first and second shield pipes is mounted, and the male and female terminals are disposed in the inner housing of the first and second housings, respectively.

7. The shield connector according the claim 6, further including:

a first ring disposed in the first shield pipe coaxially therewith for coaxially holding the first shield wire, and a second ring disposed in the second shield pipe coaxially therewith for coaxially holding the second shield wire.

8. The shield connector according to claim 6, wherein the male and female terminals are each fabricated by press-forming a thin metal plate, with their bottom faces that constitute the reference faces being used as a reference for fabrications, and a vertical distance between a bottom face and a top face of the male terminal at its distal end portion is smaller than a vertical distance between a bottom face and a top face of the female terminal.

* * * * *